US006422621B1

(12) United States Patent
Tandlich

(10) Patent No.: US 6,422,621 B1
(45) Date of Patent: Jul. 23, 2002

(54) TENNIS BALL RETRIEVING AND STORING SYSTEM

(76) Inventor: Steven Tandlich, 10851 SW. 68th St., Miami, FL (US) 33156

( * ) Notice: Subject to any disclaimer, the term of this patent is extended or adjusted under 35 U.S.C. 154(b) by 0 days.

(21) Appl. No.: 09/858,420

(22) Filed: May 16, 2001

(51) Int. Cl.[7] ..... A63B 47/02
(52) U.S. Cl. ..... 294/19.2; 414/440
(58) Field of Search ..... 294/4, 19.2; 16/429; 206/315.1, 315.9; 224/919; 220/200, 288, 485; 414/440

(56) References Cited

U.S. PATENT DOCUMENTS

| | | | | |
|---|---|---|---|---|
| 3,215,293 A | * | 11/1965 | Kelly et al. | 294/19.2 X |
| 3,227,298 A | * | 1/1966 | Shoemaker | 294/19.2 X |
| 3,604,190 A | * | 9/1971 | Wray | 294/19.2 X |
| 3,804,449 A | | 4/1974 | Falitz | |
| 3,902,749 A | | 9/1975 | Falitz | |
| 3,926,465 A | * | 12/1975 | Hoagland et al. | 294/19.2 |
| 4,461,504 A | * | 7/1984 | Perez et al. | 294/19.2 |
| 5,407,242 A | | 4/1995 | Beranek | |

FOREIGN PATENT DOCUMENTS

| | | | |
|---|---|---|---|
| FR | 2481128 | * 10/1981 | 294/19.2 |

* cited by examiner

*Primary Examiner*—Johnny D. Cherry
(74) *Attorney, Agent, or Firm*—Laurence A. Greenberg; Werner H. Stemer; Ralph E. Locher

(57) ABSTRACT

A tennis ball retriever includes a cylindrical collection drum having circular cylinder bases spaced from one another. The cylindrical collection drum has openings formed in a peripheral cylinder region such that balls can be pushed therethrough. The circular cylinder bases have sleeves extending along the cylinder axis. A removable handle includes two arms extending away from the cylinder axis. The arms have stub axles at their ends such that the stub axles extend along the cylinder axis and are rotatably journalled in the sleeves. The removable handle is resiliently deformable for moving the stub axles away from the sleeves so that the cylindrical collection drum can be removed from the handle. A ball retrieving and storing system is also provided. The ball retrieving and storing system includes at least two cylindrical collection drums and a removable handle.

11 Claims, 7 Drawing Sheets

TENNIS BALL RETRIEVING AND STORING SYSTEM

BACKGROUND OF THE INVENTION

Field of the Invention

The invention relates to a tennis ball retriever and a system for retrieving and storing tennis balls.

Various devices for retrieving tennis balls have been developed in the past. U.S. Pat. No. 3,902,749 discloses a tennis ball retriever having a handle in the form of a yoke and a pair of ground engaging rings interconnected by spaced bars to form a collection drum. A hinged gate provides access to the tennis balls picked up through the spaced bars when rolling the ground engaging rings along the ground. A Y-shaped handle is provided to facilitate the use of the tennis ball retriever. The Y-shaped handle is also used as a stand for the tennis ball retriever.

U.S. Pat. No. 3,804,449 discloses a tennis ball retriever having a handle in the form of a yoke and a pair of ground engaging rings interconnected by spaced bars to form a collection drum. One of the bars is removable to provide access to the tennis balls which have been picked up by rolling the rings along the ground.

A further tennis ball retriever is known from U.S. Pat. No. 5,407,242. A cylindrical collection drum has a plurality of circumferential tines axially spaced apart by a dimension just less than the diameter of a tennis ball. At least one of the circumferential tines has an abrasive surface for engaging the tennis ball and urging it between an axially spaced-apart pair of the circumferential tines and into the collection drum.

A disadvantage of these tennis ball retrievers is that it is time-consuming to pick up a large number of tennis balls, because every time the collection drum is filled with tennis balls, the tennis balls have to be removed from the collection drum before further tennis balls can be picked up.

SUMMARY OF THE INVENTION

It is accordingly an object of the invention to provide a ball retriever which overcomes the above-mentioned disadvantages of the heretofore-known ball retrievers of this general type and which allows to quickly pick up large numbers of balls and store them.

With the foregoing and other objects in view there is provided, in accordance with the invention, a ball retriever, including:

a cylindrical collection drum having circular cylinder bases spaced from one another, the cylindrical collection drum defining a cylinder axis, the circular cylinder bases extending perpendicular to the cylinder axis and having respective circumferential edges defining a peripheral cylinder region extending between the circumferential edges of the circular cylinder bases;

the cylindrical collection drum having openings formed in the peripheral cylinder region, the openings being dimensioned such that balls can be pushed therethrough; the circular cylinder bases having sleeves extending along the cylinder axis;

a removable handle including two arms extending away from the cylinder axis, the arms having respective end regions and stub axles at the end regions, the stub axles extending along the cylinder axis and being rotatably journalled in the sleeves; and the removable handle being resiliently deformable for moving the stub axles away from the sleeves.

According to the invention, the handle is removable from the collection drum and thus the collection drum can be easily replaced. When collecting tennis balls, it is not necessary to empty out the filled collection drum before further balls can be collected. The full collection drum can be replaced with an empty drum and further balls can be collected.

In accordance with another feature of the invention, the cylindrical collection drum has bars disposed in the peripheral cylinder region; the bars extend parallel to the cylinder axis and are spaced from one another for forming the openings.

In accordance with yet another feature of the invention, at least one of the bars is a removable bar with a threaded end region. This allows to open the collection drum by unscrewing and removing the bar.

In accordance with another feature of the invention, at least one tubular bar holder is attached to one of the arms for holding the removable bar.

In accordance with a further feature of the invention, at least one of the bars is hingedly connected at one of the circumferential edges in order to facilitate opening the collection drum.

In accordance with yet a further feature of the invention, one of the bars is hingedly connected at one of the circumferential edges, and a further one of the bars adjacent the one of the bars is hingedly connected at another one of the circumferential edges. Thus, a sufficiently large opening for emptying out the tennis balls is provided.

In accordance with yet another feature of the invention, each of the circular cylinder bases includes a first ring and a second ring; the first ring is an outermost ring and is disposed concentric with respect to the second ring. A plurality of bent bars each has a V-shape; each of the bent bars has a first end attached to the first ring or the second ring, a second end attached to the first ring or the second ring and a bend region disposed close to the cylinder axis. This allows to manufacture the circular cylinder bases in a cost effective manner with only a few parts.

In order to further reduce manufacturing costs, the circular cylinder bases are molded plastic discs, and the bars have respective ends fixed to the molded plastic discs. The bars may preferably be glued to the molded plastic discs.

In accordance with yet a further feature of the invention, each of the circular cylinder bases includes a plurality of concentric rings, and radially extending bars attached to the concentric rings.

In accordance with another feature of the invention, the circular cylinder bases include rings extending along the peripheral edges, and an elastic material, such as a rubber material or a plastic, covers the rings. The elastic material prevents markings on the surface of the tennis court when the collection drum is rolled on the ground. The elastic material also absorbs shocks and improves traction when the collection drum is rolled on the ground.

In accordance with yet another feature of the invention, the arms are telescoping arms. The telescoping arms allow adjusting the height of the handle for people of different height. When the handle is used as a stand, the collection drum can be positioned at a height which is convenient for emptying the tennis balls from the collection drum. When the telescoping arms are shortened, a user may carry the ball retriever by carrying the handle over his or her shoulder.

In accordance with a further feature of the invention, the arms are Y-shaped arms and the handle includes two handle bars extending parallel to the cylinder axis; the handle bars connect the Y-shaped arms. This handle configuration allows using the handle as a stand.

With the objects of the invention in view there is also provided, a ball retrieving and storing system, including:

a cylindrical collection drum having circular cylinder bases spaced from one another, the cylindrical collection drum defining a cylinder axis, the circular cylinder bases extending perpendicular to the cylinder axis and having respective circumferential edges defining a peripheral cylinder region extending between the circumferential edges of the circular cylinder bases;

the cylindrical collection drum having openings formed in the peripheral cylinder region, the openings being dimensioned such that balls can be pushed therethrough;

the circular cylinder bases having sleeves extending along the cylinder axis;

a removable handle including two arms extending away from the cylinder axis, the arms having respective end regions and stub axles at the end regions, the stub axles extending along the cylinder axis and being rotatably journalled in the sleeves;

the removable handle being resiliently deformable for moving the stub axles away from the sleeves for removing the cylindrical collection drum from the handle; and a further cylindrical collection drum substantially identical to the cylindrical collection drum for exchanging the cylindrical collection drum with the further cylindrical collection drum.

Using a handle together with a number of collection drums allows not only to quickly pick up a large number of tennis balls but also allows to conveniently store the tennis balls in the collection drums. It is no longer necessary to transfer the tennis balls from the collection drum into a separate storage container. The collection drum preferably has a holding capacity of between 40 and 150 tennis balls. This provides a sufficient collecting capacity without making the collection drum too big and heavy to handle. Because of the expandable storage option due to replaceable collection drums, a collection drum capacity of between 60 and 100 tennis balls is preferred.

Other features which are considered as characteristic for the invention are set forth in the appended claims.

Although the invention is illustrated and described herein as embodied in a ball retrieving and storing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
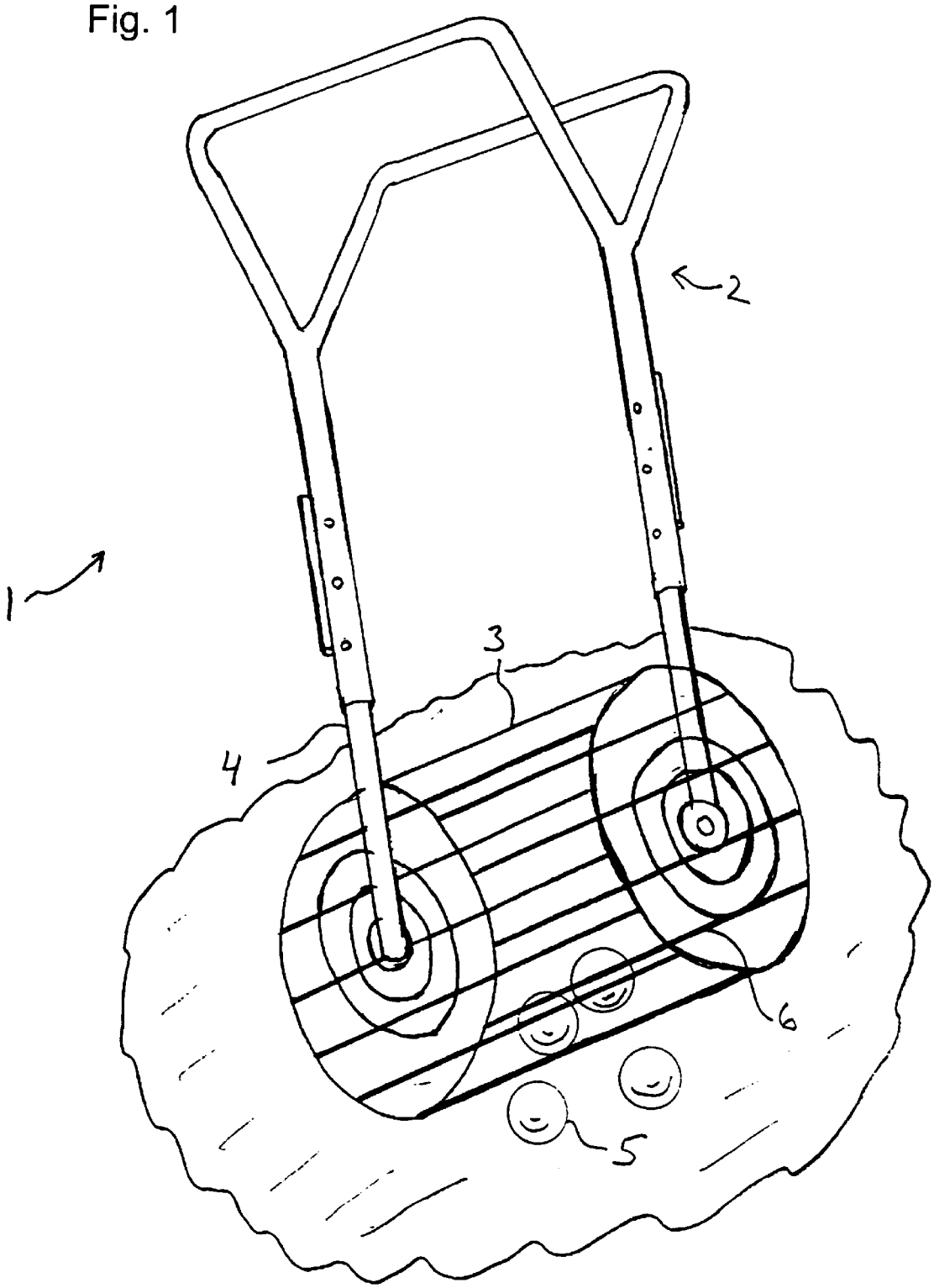
FIG. 1 is a diagrammatic perspective view of a tennis ball retriever according to the invention.

Referring now to the figures of the drawings in detail and first, particularly, to FIG. 1 thereof, there is shown a tennis ball retriever 1 including a removable handle 2 and a cylindrical collection drum 3 rotatably journalled on the removable handle 2. The collection drum 3 can rotate in either direction.

Operation of the tennis ball retriever 1 is illustrated in FIG. 1. A user pushes, with the handle 2, the collection drum 3 along the ground, thus rotating the collection drum 3 as it advances across the ground. The handle 2 has two telescoping arms 4 whose length can be adjusted to allow a user to operate the tennis ball retriever 10 while standing or walking. The user rolls the collection drum to a tennis ball 5, which is pushed between the bars 6 and into the collection drum 3 as the collection drum advances. The bars are spaced at a distance slightly smaller than the diameter of a tennis ball.

Figure 2:
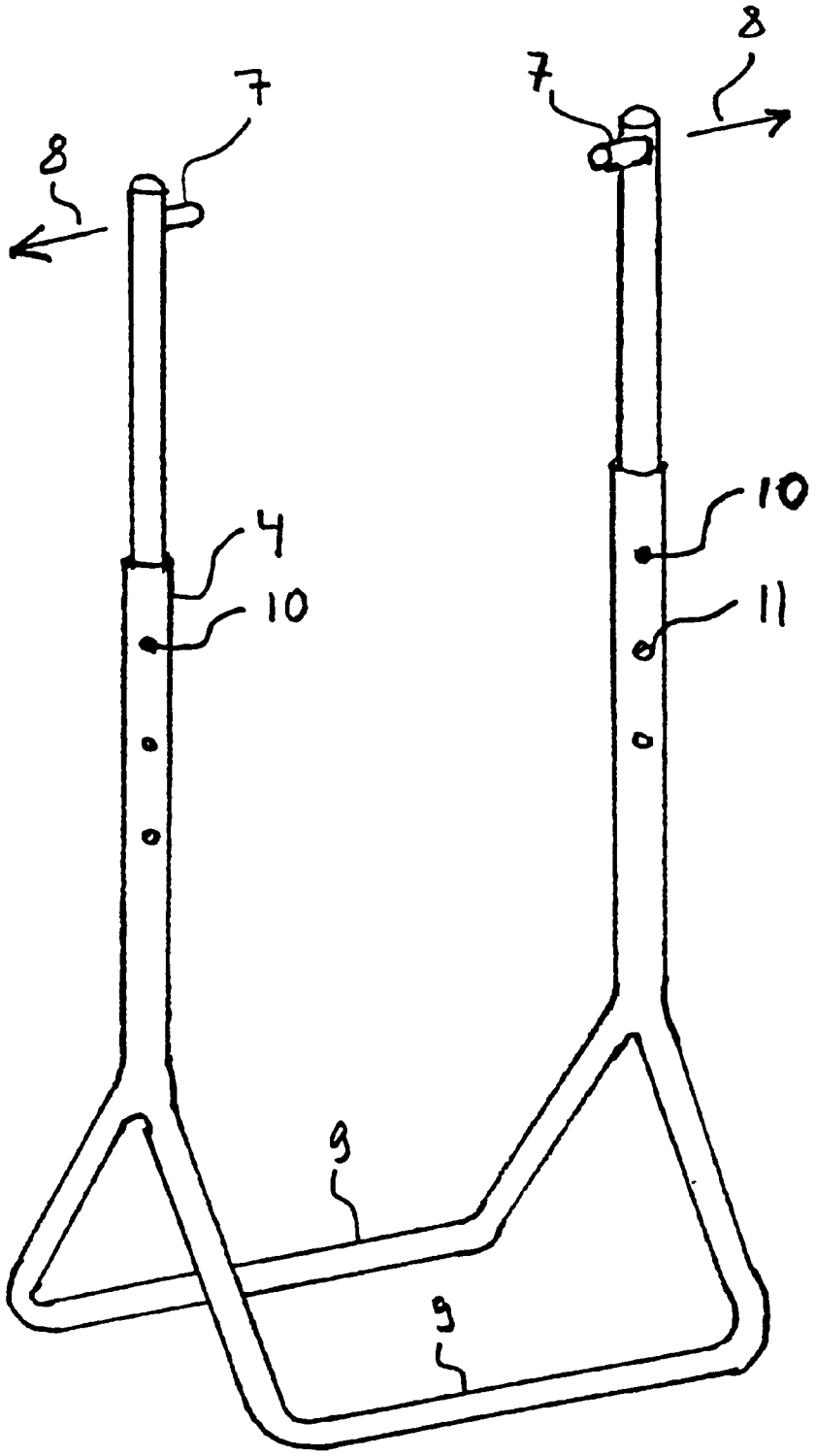
FIG. 2 is a diagrammatic perspective view of the removable handle according to the invention.

FIG. 2 is a diagrammatic perspective view of the removable handle 2. The handle 2 includes telescoping arms 4 for adjusting the length of the handle 2. The arms have stub axles 7 at their end regions. The stub axles may for example be a piece of a pipe which is welded to a telescoping arm 4. The handle 2 is resiliently deformable in the direction indicated by the arrows 8 for moving the stub axles away from the collection drum 3. The collection drums are thus replaceable and can be used not only for collecting balls but also for storing balls. In other words, the drum 3 is a collection and storage drum. The arms 4 are Y-shaped arms. Two handle bars 9 extending parallel to the cylinder axis connect the Y-shaped arms 4. FIG. 2 illustrates that the telescoping arms 4 can be adjusted to three different settings by locking pins 10 in corresponding holes 11.

Figure 3:
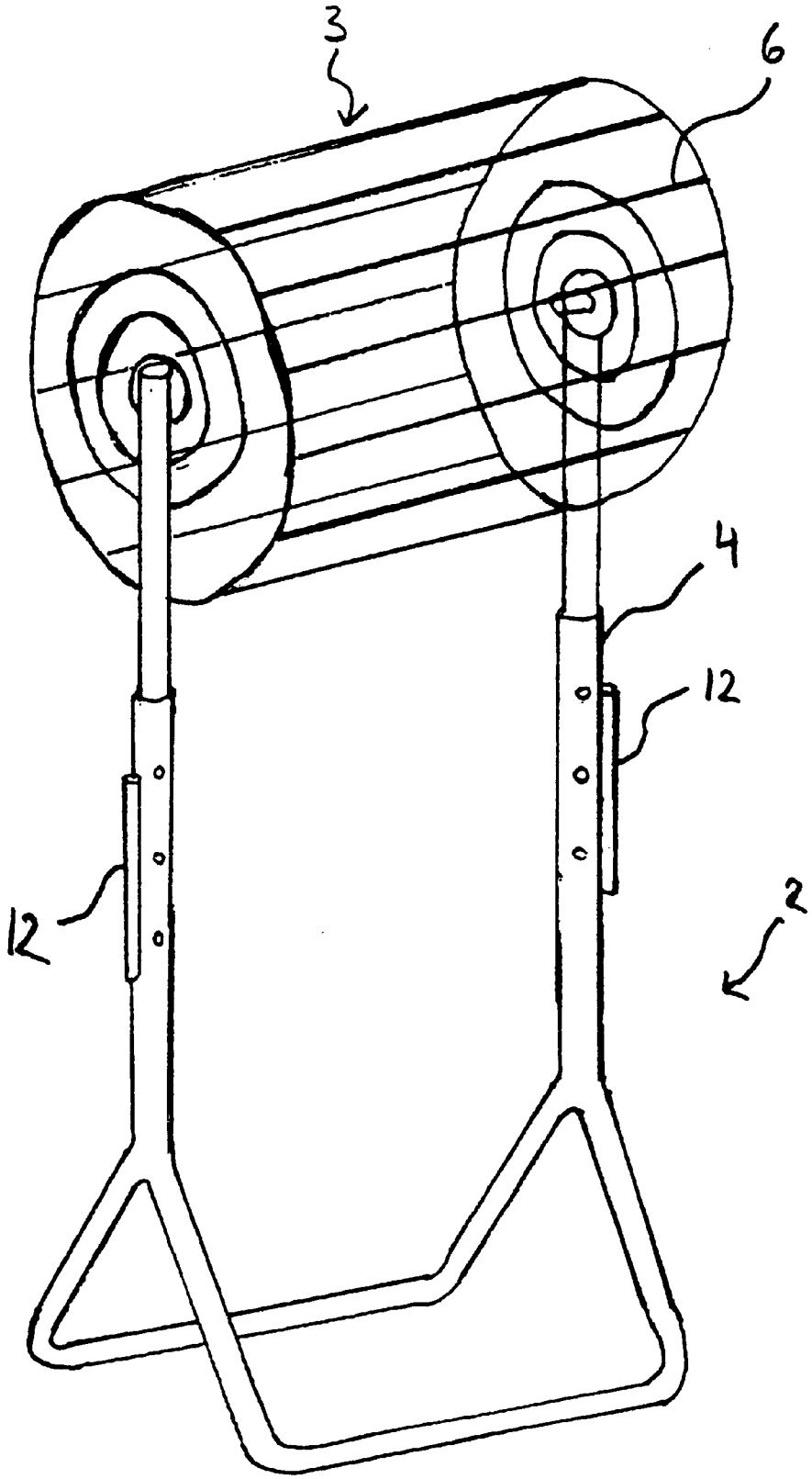
FIG. 3 is a diagrammatic perspective view of a tennis ball retriever according to the invention when the handle is being used as a stand.

FIG. 3 is a diagrammatic perspective view of a tennis ball retriever according to the invention when the handle is being used as a stand. The height of the collection drum 3 can be adjusted by extending the telescoping arms 4 to a suitable length. Tubular bar holders 12 are fixed to the arms 4 for holding a bar 6 that is removed from the collection drum 3 when the tennis balls are taken out of the collection drum 3.

Figure 4:
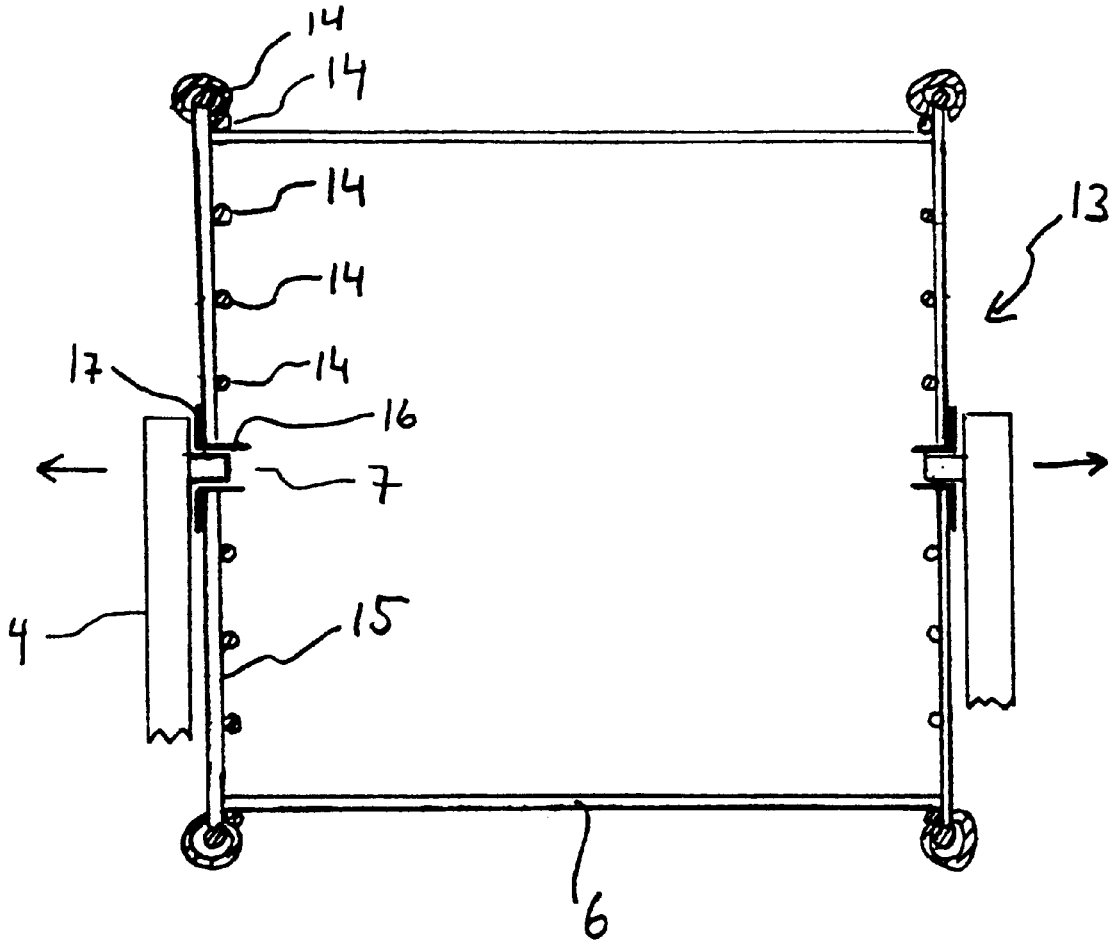
FIG. 4 is a diagrammatic partial sectional view of a tennis ball retriever according to the invention.

FIG. 4 is a diagrammatic partial sectional view of the tennis ball retriever 1. The collection drum 3 has circular cylinder bases 13 which are formed by concentric rings 14 and radially extending spokes 15. The outermost ring 14 forms a circumferential edge of the circular cylinder base 13. The proximal ends of at least some of the spokes 15 are attached to a bearing bushing or sleeve 16 in which the stub axle 7 is received. A disc 17 may be fixed to the sleeve 16 in order to facilitate the rotation of the collection drum 3 on the stub axles 7. As is indicated by the arrows, the arms 4 can be elastically bent away from the collection drum 3 so that the stub axles 7 are pulled out of the sleeves 16. The distal ends of at least some of the spokes 15 are attached to the outermost one of the rings 14.

Figure 5:
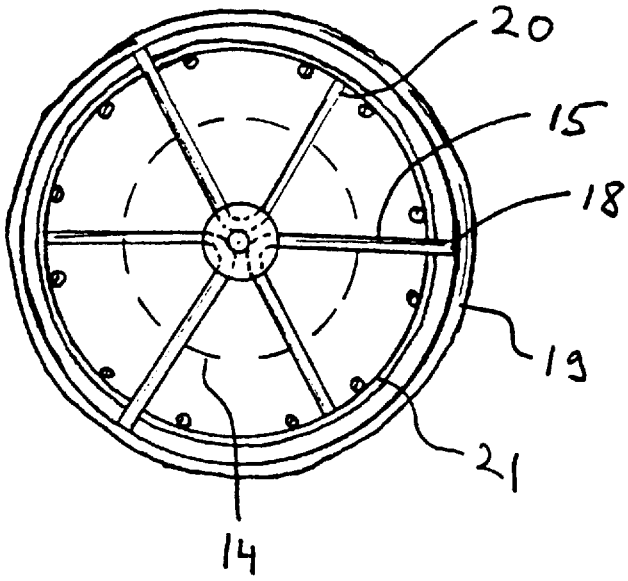
FIG. 5 is a diagrammatic plan view of a first embodiment of the base of the cylindrical collection drum according to the invention.

FIG. 5 is a diagrammatic plan view of a first embodiment of the base of the cylindrical collection drum according to the invention. The spokes 15 are formed by bars that are bent into a V-shape. Each of the bent bars has a first end 18 attached to an outermost ring 19. A second end 20 of the bent bar is attached to a ring 21 that is smaller in diameter than the outermost ring 19. Further rings 14 may be provided for keeping the tennis balls inside the collection drum 3.

Figure 6:
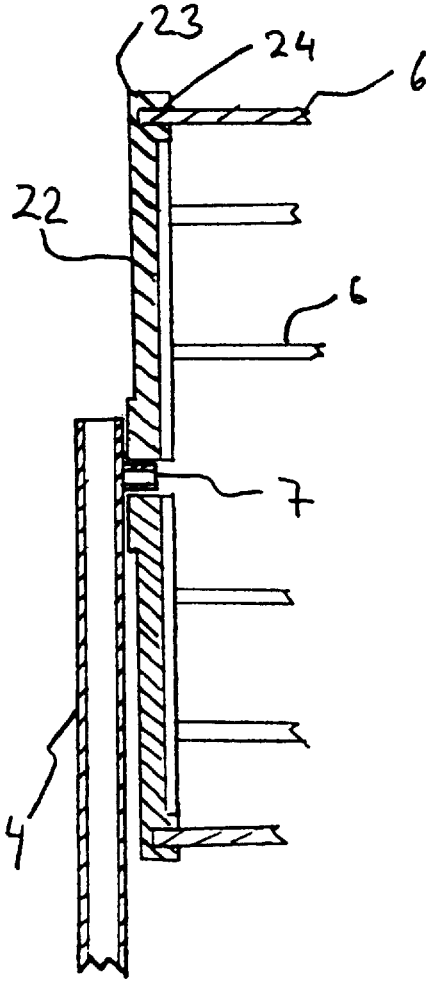
FIG. 6 is a diagrammatic partial sectional view of a second embodiment of the base of the cylindrical collection drum according to the invention.

FIG. 6 is a diagrammatic partial sectional view of a second embodiment of the base of the cylindrical collection drum according to the invention. The base of the collection drum 3 may advantageously be a molded plastic disc 22. The disc 22 has at its circumferential edge 23 holes 24. The bars 6 can be fixed to the disc 22 by gluing the bars 6 into the holes 24. The central part of the disc 22 forms the sleeve or bushing for the stub axle 7. The central part of the disc 22 may be reinforced with a metal sleeve part in order to reduce wear.

Figure 7:
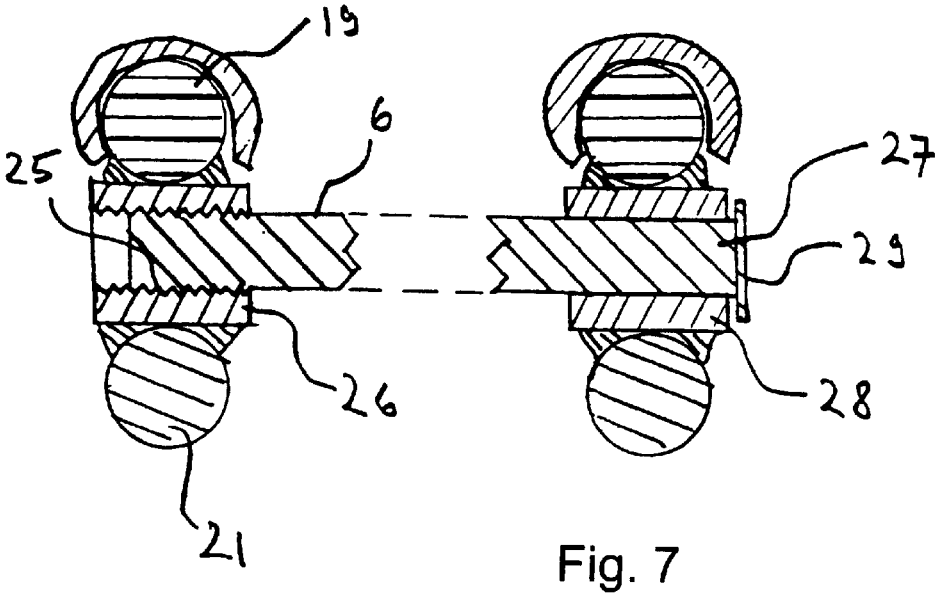
FIG. 7 is a diagrammatic partial sectional view of the circumferential edges of the collection drum for illustrating an embodiment of a removable bar according to the invention.

FIG. 7 is a diagrammatic partial sectional view of the circumferential edges of the collection drum for illustrating an embodiment of a removable bar 6 according to the invention. In order to provide an opening in the collection drum 3 for removing the tennis balls, at least one of the bars can be embodied as a removable bar. One end 25 of the bar 6 has a thread so that the bar 6 can be threaded into a threaded sleeve or nut 26. The threaded sleeve is welded to the outermost ring 19 and/or a ring 21 disposed inside the outermost ring 19. The other end 27 of the bar 6 is held in a non-threaded sleeve 28. A plate 29, which is provided at the end 27 of the bar 6, acts as a stop when the bar is threaded into the nut 26.

Figure 8:
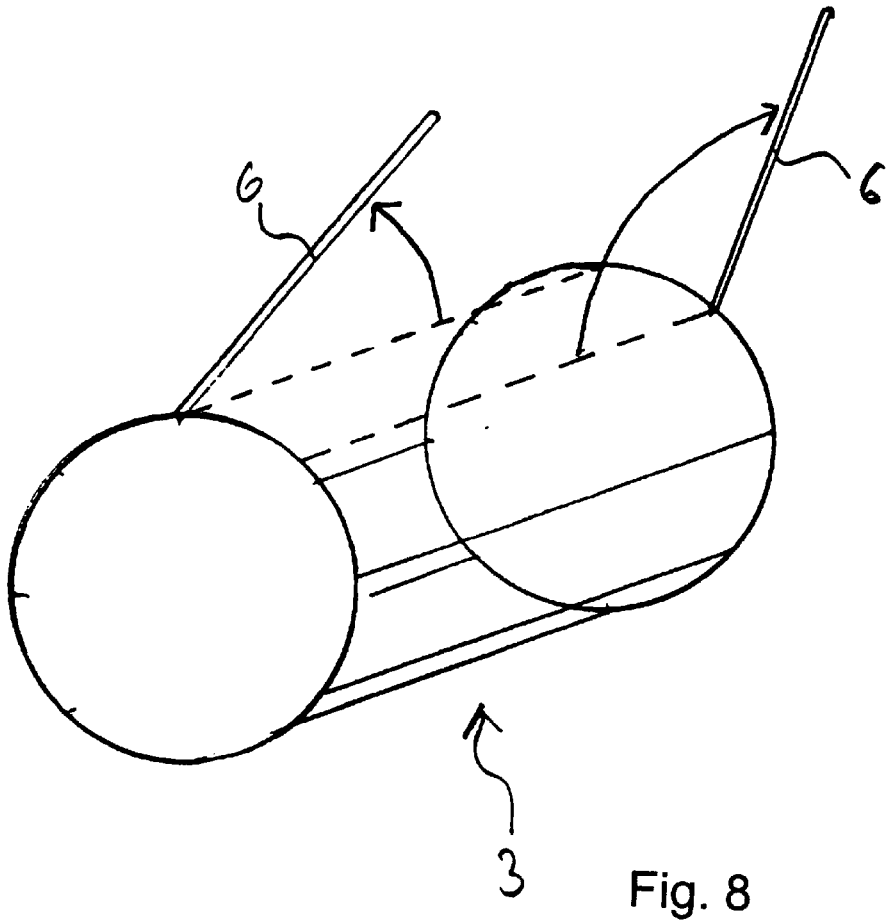
FIG. 8 is a schematic perspective view of the collection drum with two hinged bars according to the invention.

FIG. 8 is a schematic perspective view of the collection drum 3 with two hinged bars 6 according to the invention. In order to provide a large enough opening for removing the tennis balls from the collection drum 3, two adjacent bars are hingedly connected at respectively opposite sides of the collection drum 3. The hinged bars can be pivoted or swivelled by about 270°.

Figure 9:
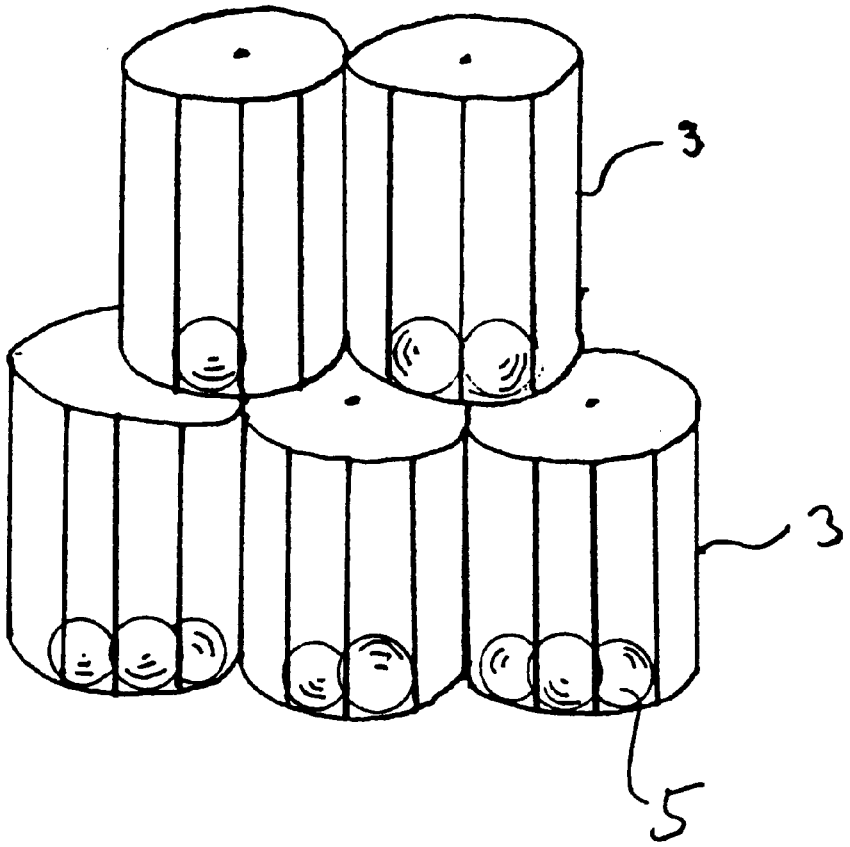
FIG. 9 is a diagrammatic perspective view of collection drums used for the purpose of storing tennis balls.

FIG. 9 is a diagrammatic perspective view of collection drums 3 used for storing tennis balls. The ball retrieving and storing system according to the invention includes a handle 2 and a number of drums 3 which in this case are collection and storage drums. A user can, for example, collect tennis balls 5 until a first drum is filled. Then, rather that emptying out the drum and continuing with the same drum, the user replaces the full drum with an empty drum. The user can in this manner fill a number of drums and store the tennis balls in the drums rather than emptying out the drum each time it is full. The retrieving and storing system allows to quickly retrieve and store a large number of tennis balls.

I claim:

1. A ball retriever, comprising:

a cylindrical collection drum having circular cylinder bases spaced from one another, said cylindrical collection drum defining a cylinder axis, said circular cylinder bases extending perpendicular to the cylinder axis and having respective circumferential edges defining a peripheral cylinder region extending between said circumferential edges of said circular cylinder bases;

said cylindrical collection drum having openings formed in said peripheral cylinder region, said openings being dimensioned such that balls can be pushed therethrough, said cylindrical collection drum having bars disposed in the peripheral cylinder region, said bars extend parallel to the cylinder axis and are spaced from one another for forming said openings, at least one of said bars being a removable bar with a threaded end region;

said circular cylinder bases having sleeves extending along the cylinder axis;

a removable handle including two arms extending away from the cylinder axis, said arms having respective end regions and stub axles at said end regions, said stub axles extending along the cylinder axis and being rotatably journalled in said sleeves; and said removable handle being resiliently deformable for moving said stub axles away from said sleeves.

2. The ball retriever according to claim 1, wherein at least one of said bars is hingedly connected at one of said circumferential edges.

3. The ball retriever according to claim 1, including at least one tubular bar holder attached to one of said arms for holding said removable bar.

4. The ball retriever according to claim 1, wherein:

said circular cylinder bases are molded plastic discs; and said bars have respective ends fixed to said molded plastic discs.

5. The ball retriever according to claim 1, wherein each of said circular cylinder bases includes:

a plurality of concentric rings; and radially extending bars attached to said concentric rings.

6. The ball retriever according to claim 1, wherein said circular cylinder bases include rings extending along said peripheral edges, and an elastic material covers said rings.

7. The ball retriever according to claim 1, wherein said arms are telescoping arms.

8. The ball retriever according to claim 1, wherein:

said arms are Y-shaped arms; and said handle includes two handle bars extending parallel to the cylinder axis, said handle bars connect said Y-shaped arms.

9. A ball retrieving and storing system, comprising:

a cylindrical collection drum having circular cylinder bases spaced from one another, said cylindrical collection drum defining a cylinder axis, said circular cylinder bases extending perpendicular to the cylinder axis and having respective circumferential edges defining a peripheral cylinder region extending between said circumferential edges of said circular cylinder bases;

said cylindrical collection drum having openings formed in said peripheral cylinder region, said openings being dimensioned such that balls can be pushed therethrough;

said circular cylinder bases having sleeves extending along the cylinder axis;

a removable handle including two telescoping arms extending away from the cylinder axis, said telescoping arms having respective end regions and stub axles at said end regions, said stub axles extending along the cylinder axis and being rotatably journalled in said sleeves;

said removable handle being resiliently deformable for moving said stub axles away from said sleeves for removing said cylindrical collection drum from said handle; and a plurality of further cylindrical collection drums substantially identical to said cylindrical collection drum for exchanging said cylindrical collection drum with said further cylindrical collection drums.

10. A ball retriever, comprising:

a cylindrical collection drum having circular cylinder bases spaced from one another, said cylindrical collection drum defining a cylinder axis, said circular cylinder bases extending perpendicular to the cylinder axis and having respective circumferential edges defining a peripheral cylinder region extending between said circumferential edges of said circular cylinder bases;

said cylindrical collection drum having openings formed in said peripheral cylinder region, said openings being dimensioned such that balls can be pushed therethrough;

said cylindrical collection drum having bars disposed in the peripheral cylinder region, said bars extend parallel to the cylinder axis and are spaced from one another for forming said openings, one of said bars being hingedly connected at one of said circumferential edges;

a further one of said bars adjacent said one of said bars being hingedly connected at another one of said circumferential edges;

said circular cylinder bases having sleeves extending along the cylinder axis;

a removable handle including two arms extending away from the cylinder axis, said arms having respective end regions and stub axles at said end regions, said stub axles extending along the cylinder axis and being rotatably journalled in said sleeves; and said removable handle being resiliently deformable for moving said stub axles away from said sleeves.

11. A ball retriever, comprising:

a cylindrical collection drum having circular cylinder bases spaced from one another, said cylindrical collection drum defining a cylinder axis, said circular cylinder bases extending perpendicular to the cylinder axis and having respective circumferential edges defining a peripheral cylinder region extending between said circumferential edges of said circular cylinder bases;

each of said circular cylinder bases including a first ring and a second ring, said first ring being an outermost ring and being disposed concentric with respect to said second ring, and each of said circular cylinder bases including a plurality of bent bars having a V-shape, each of said bent bars having a first end attached to one of said first ring and said second ring, a second end attached to one of said first ring and said second ring and a bend region disposed close to the cylinder axis;

said cylindrical collection drum having openings formed in said peripheral cylinder region, said openings being dimensioned such that balls can be pushed therethrough;

said circular cylinder bases having sleeves extending along the cylinder axis;

a removable handle including two arms extending away from the cylinder axis, said arms having respective end regions and stub axles at said end regions, said stub axles extending along the cylinder axis and being rotatably journalled in said sleeves; and said removable handle being resiliently deformable for moving said stub axles away from said sleeves.

* * * * *